United States Patent [19]

Chou

[11] Patent Number: 4,815,647

[45] Date of Patent: Mar. 28, 1989

[54] MULTIPLE-FUNCTION MAGAZINE FOR TEE NAILS TO BE USED WITH A NAILING GUN

[76] Inventor: Joseph S. Y. Chou, 12, Lane 428, Chung Cheng N. Rd., San Chung City, Taipei Hsien, Taiwan

[21] Appl. No.: 928,367

[22] Filed: Nov. 10, 1986

[51] Int. Cl.[4] ..... B25C 1/04; B27F 7/14

[52] U.S. Cl. ..... 227/109; 227/120

[58] Field of Search ..... 227/120, 109, 130, 131

[56] References Cited

U.S. PATENT DOCUMENTS

| | | | |
|---|---|---|---|
| 3,720,364 | 3/1973 | Maestri | 227/109 |
| 4,304,349 | 12/1981 | Novak et al. | 227/109 |
| 4,375,867 | 3/1983 | Novak et al. | 227/109 |

*Primary Examiner*—Paul A. Bell

*Attorney, Agent, or Firm*—Leonard Bloom

[57] ABSTRACT

A multi-function magazine for tee nails which accommodates nails of different lengths simultaneously and from which nails exit straight, free of jamming. The magazine comprises a housing having at least one longitudinal groove on the inner wall. Slidably mounted on the housing is a cover with a longitudinal groove opposed to, and complementary of the groove in the housing, thereby forming a trackway for the tee nails. A releasable latch means retains the magazine in a closed position and also enables the cover to be slidably moved rearwardly to load the nails from the side of the magazine. A stop means prevents complete separation of the housing and the cover. A pusher, slidably mounted between the housing and the cover, is in contact with the shanks of the nails. The pusher is urged by a spring to push the nails forwardly in the magazine.

14 Claims, 3 Drawing Sheets

MULTIPLE-FUNCTION MAGAZINE FOR TEE NAILS TO BE USED WITH A NAILING GUN

BACKGROUND

As a multiple-function magazine for tee nails used with a nailing gun, this invention is especially ideal for nailing guns that are used for driving tee nails of different types and lengths.

Currently, the traditional nailing guns are generally used in the woodwork, decoration industries and homes as well, because they can work speedily and accurately and can be operated easily and conveniently. However, there are various types of nails and a traditional nailing gun is only useful for one type of nail. This results in inconvenience for those who should use different types of nails at the same time. Years ago, some new magazines were designed for tee nails in different lengths, such as MAX magazine introduced by Japanese manufacturers, which made contact with the tips of the tee nails of different lengths by means of the change of the stopping block. But since the height of the magazine was designed on the basis of the total length of the longest tee nail, when it was used for shorter tee nails, nails were required to traverse a distance before exiting the instrument and the nails did not move in a straight path but exited at an angle or became stuck at the exit of the instrument. Also, since the nails were loaded into the top side of the magazine, the nailing gun's positioning over the magazine interfered with the operation of the instrument. Another magazine was designed for nails with smaller nail heads, in which the nails were loaded from the bottom side of the magazine. This magazine was not satisfactory either. Besides, since the width of the groove in which the nails were retained was designed based on the width of the nail head, the nails either exited from the instrument at an angle, or the nails jammed at the exit of the instrument. In sum, neither of the aforementioned improved magazines could minimize the problems of the users.

Finding all the defects of both of the traditional nailing guns and the improved ones, the inventor of this product began to concentrate his research and experiments on modifying the defects.

OBJECT OF INVENTION

The major purpose of this invention is to provide a magazine for a nailing gun suitable for tee nails of different types with no need of any adjustment.

Another purpose of this invention is to provide a magazine for a nailing gun which can stably propel the tee nails to the driver, and maintain its stability even when undergoing violent shocks during the operation of the nailing gun.

The other features of this invention is that, although nails of differing lengths are used, the tips of the nails are equidistant from the exit of the nailing gun and straight ejection without jamming is ensured.

In addition, this invention provides users with convenience when they feed tee nails from one side of the magazine.

Following are described the elements of the new invention and their interrelated actions with the drawing attached for readers' reference.

DETAILED DESCRIPTION OF INVENTION

Figure 1:
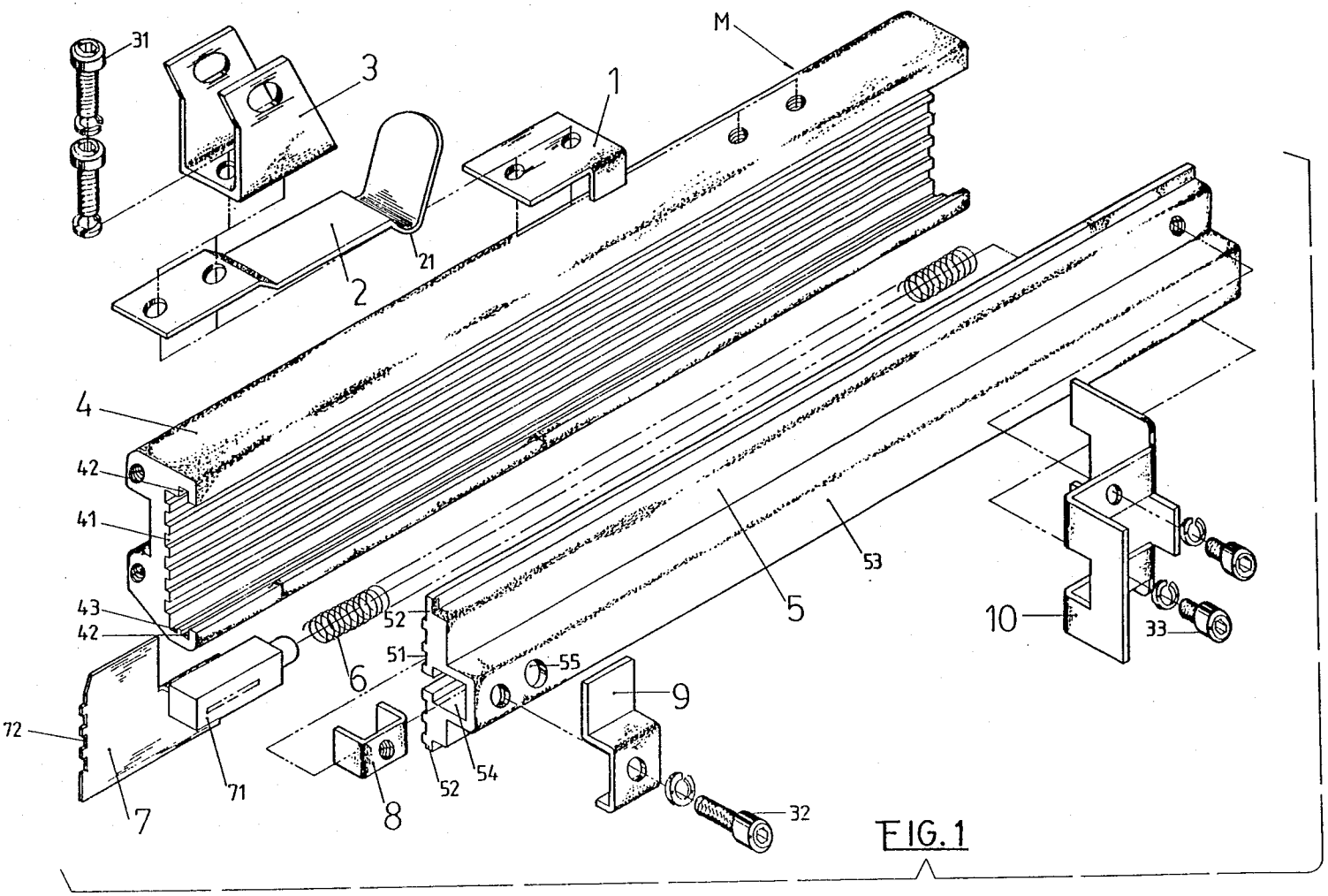
FIG. 1 is a pictorial drawing illustraing the elements of the structure of the multiple-function magazine for tee nails to be used with a nailing gun.
Figure 2:
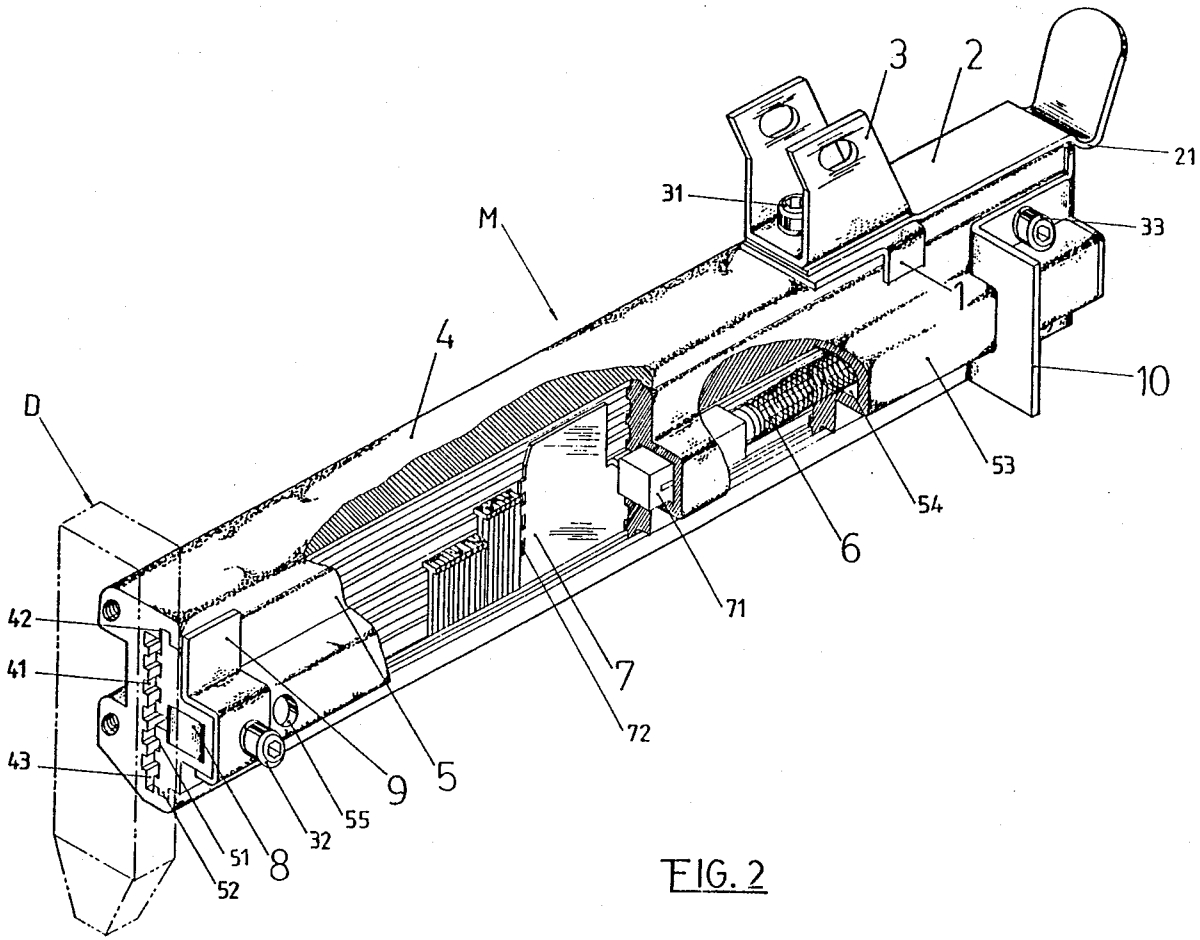
FIG. 2 is a sectional drawing of part of the multiple-function magazine for tee nails.

This newly-developed multiple-function magazine M for tee nails to be used with a nailing gun D is composed of a magazine housing 1, an outer cover 5, a pusher mechansim and a stopping mechanism. The said housing 4 is slidably mounted in the outer cover 5 so as to form room for tee nails; the pusher mechanism comprises a compression spring 6, a pusher plate 7 and a stopping block 8 which is fixed between the housing 4 and the outer cover 5, the propelling mechanism can push the tee nails forwardly in the trackway formed by the housing 4 and the outer cover 5; the stopping mechanism composed of a checking plate 1, fixed on the housing 4, and a stopping plate 9, fixed on the outer cover can prevent complete separation of the outer cover when tee nails are fed in or taken out. Below are described the main elements of the structure including their shapes and functions.

The housing 4 is in the shape of the letter "U", on one side of which are designed several parallel grooves 41 which extend longitudinally the entire length of the housing 4, on the top and at the bottom of the housing 4 are designed guide rail type grooves (or tracks) 42 separately and which are opposite to each other, beside the guide rail type groove at the bottom of the box and near the groove 41 is designed a nail groove 43 parallel to the guide rail type groove 42; besides, there is an outer cover 5 which is in the shape of the letter "T" and is slidably mounted in the housing 4; on one side of the outer cover is designed a groove 51 complementary of the groove 41 in the housing 4, on the outer cover is designed a protrudent strip 53, and inside the protrudent strip 53 is designed a "T"-shape long concave groove (or channel) 54 whose opening is located in the middle of the groove 51, and on the protrudent strip 53 and near its front (or first) end is an opening (or window) 55; and a pair of parallel convex rails 52 are separately fixed on the upper and lower side of the outer cover 5 which can be slidably mounted in the guide rail type grooves 42 on the housing 4. Using the guide rail type groove 42 and the convex rail 52 on the outer cover 5, you can slidably mount the housing 4 in the outer cover 5 and form a container (magazine) in which to place the tee nails; at the end of the outer cover 5 is designed a handle and end cover 10 which is fixed and fastened with screws 33 to the outer cover 5 so as to make the outer cover 5 easily movable and to permit the closure of the housing 4 and the outer cover 5.

The pusher mechanism comprising a compression spring 6, a pusher plate 7 and a stopping block 8 is fixed between the housing 4 and the outer cover 5, inside the T-shape long concave groove 54 of the protrudent strip 53 is placed a compression spring 6, at the front end of which is fixed a sliding block 71 secured to the pusher plate 7, and this sliding block 71 is fixed by a convenient method which can slide in the long convex goove 54, and the pusher plate 7 just projects out of the opening of the long concave groove 54 and is fixed in the space between the housing 4 and the outer cover 5, and this can facilitate the sliding of the pusher plate in the groove to push the tee nails to the apparatus feed; in the front of the pusher plate is designed protrudent teeth 72, forming notches in the edge of the plate, the notches being opposite to the gooves on the magazine 4 which are used for placing nail heads and preventing the swing (or translational movement) of the nails when being pushed forward; a stopping block 8 is fixed in front of the sliding block 71 of the pusher plate 7 so as to make the compression spring generate elastic push when undergoing pressure and to stably and evenly push the tee nails to move forward.

The stopping mechanism include a checking plate 1 and a stopping plate 9; the checking plate 1 is located over the housing 4 and near the back (or second) part and is secured together by a screw 31 with an elastic push button (or releasable latch) 2 and a connection stand of the gun body 3; at the back part of the push button 2 is designed a downward arc of protrudent block (or protuberance) 21 which is used for bracing (or engaging) the end cover 10 at the end of the outer cover 5 so as to stop the moving of the outer cover 5, and the connection stand of the gun body 3 is connected with the nailing gun body; the other longer stopping plate 9 is fixed on the outer cover 5 and near the front end of the cover, this stopping plate is secured with a screw 32 together with the stopping block 8 in the long concave groove 54 so that when tee nails should be removed from the outer cover 5, the stopping plate 9 fixed on the outer cover 5 is blocked by the checking plate 1 on the housing 4 and prevents the complete separation of the outer cover 5.

Figures 3, 4:
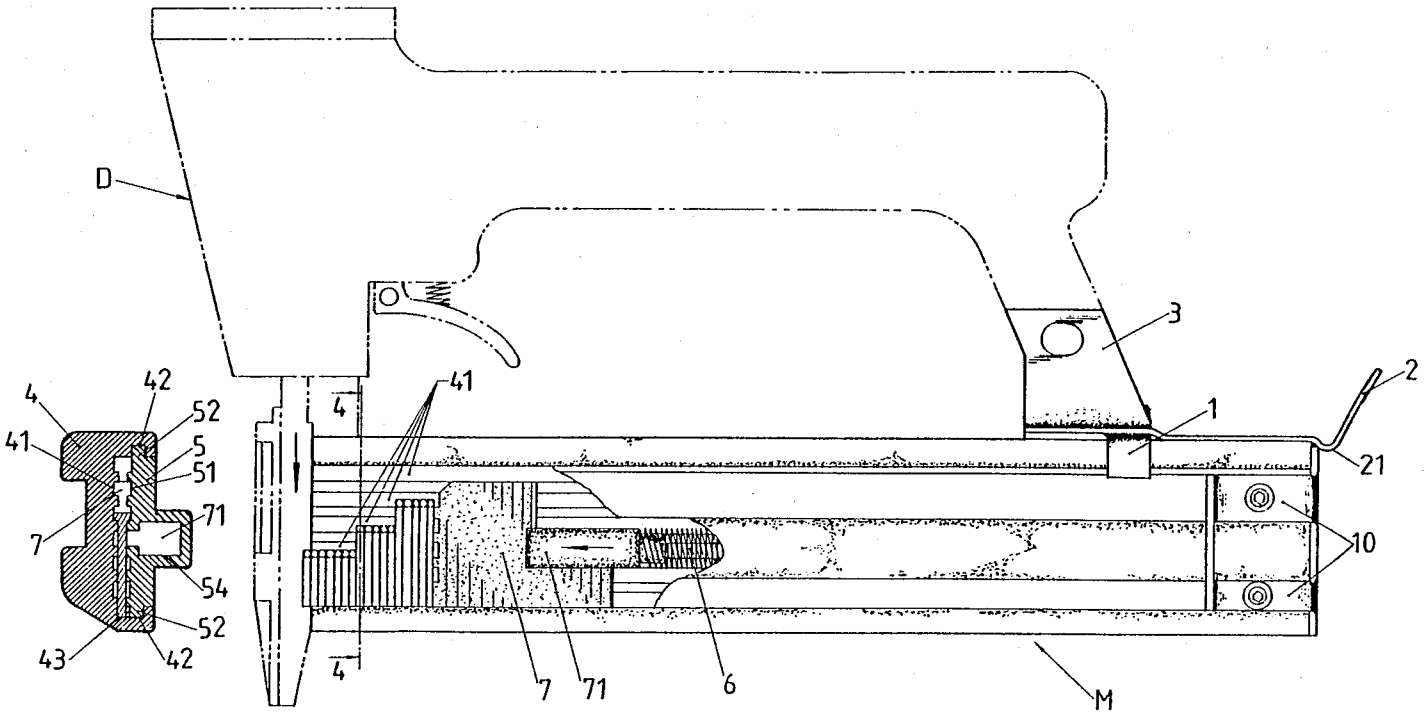
FIG. 3 is a diagrammatic drawing of the multiple-function magazine for tee nails in the course of performance.
FIG. 4 shows the position of the tee nails in the multiple-function magazine for tee nails.

The aforementioned is the description of the structure of the multiple-function magazine for tee nails. The following are described the features and the operation method of this invention so as to make users have a better understanding. When placing tee nails in the magazine, the elastic press button 2 should be first tipped up by the index finger and the whole outer cover 5 can be easily pulled out by the end cover 10 using the thumb, and the stopping plate 9 on the outer cover 5 is blocked by the checking plate 1 on the housing 4 so that the outer cover 5 is not completely separated, the tee nails are then placed in the nail groove 43 of the housing 4 from the side of the magazine, and push the outer cover 5 until its end is fastened by the elastic press button 2, the nail heads of the tee nails are placed in the groove opposite to the housing and the outer cover, and the nail bodies are located between the housing 4 and the outer cover 5 as shown in FIG. 4, under such case, the whole tee nails are stabilized and fixed bythe housing 4 and the side wall of the outer cover 5, in addition, since the compression spring 6 is located in the midpoint of the pusher plate 7, when it undergoes push force, the tee nails then move forward stably and keep stability even when the nailing gun meets strong shocks, (see FIG. 3); the groove 54 with an opening 55 on the outer cover 5 allow users to see how many nails are left. This design provides operators with much convenience in using the nailing gun.

Obviously, many modifications may be made without deparating from the basic spirit of the present invention. Accordingly, it will be appreciated by those skilled in the art that within the scope of the appended claims, the invention may be practiced other than has been specifically described herein.

I claim:

1. In a tool for driving tee nails, wherein the tool is provided with a magazine having a longitudinal trackway for the nails, wherein the magazine includes a magazine housing and a slidable cover thereon, and wherein the cover may be slidably extended rearwardly of the magazine housing to facilitate a loading of the nails laterally of the tool and into the trackway in the magazine, the improvement which comprises the magazine housing and the slidable cover having respective longitudinal internal grooves formed therein, the rooves being complementary to one another and communicating therewith, and the nails each comprising a shank portion having a tee-shaped head portion, wherein the tee-shaped head portions of the respective nails are supported within the respective complementary communicating internal longitudinal grooves for sliding movement therein forwardly of the magazine.

2. The improvement of claim 1, wherein the tee nails further include respective point portions, wherein the point portions of the nails clear the trackway in the magazine, and wherein the nails are slidably supported in the trackway only by their resepctive tee-shaped head portions within the complementary communicating internal longitudinal grooves in the magazine housing and slidable cover, respectively.

3. The improvement of claim 1, further including a plurality of parallel complementary internal longitudinal grooves formed in the magazine housing and slidable cover, respectively, thereby accommodating tee-shaped headed nails of different lengths, respectively.

4. A tool for driving tee-shaped nails, wherein the tool includes a magazine for receiving the nails, and wherein each nail includes a shank portion and further includes a tee-shaped head portion extending substantially at right angles to the shank portion, the combination comprising:

a magazine housing having an exterior wall and an interior wall, the interior wall having first and second ends, respectively, and the interior wall further having at least one groove extending longitudinally thereof from the first end to the second end thereof;

a cover slidably mounted on the magazine housing, the cover having an exterior wall and an interior wall, the interior wall of the cover having first and second ends, respectively, and the interior wall of the cover further having at least one groove extending longitudinally thereof from the first end to the second end thereof; wherein when the cover is in a normal closed position covering the magazine housing, the groove in the cover is opposed to, and complementary of, the groove in the magazine housing, thereby forming at trackway for the tee nails in the magazine;

means for mounting the cover on the magazine housing, so that the cover may be slidably extended rearwardly of the magazine housing comprising a pair of parallel longitudinal rails formed on the cover, and the magazine housing having a pair of complementary parallel longitudinal guide tracks formed therein to receive the rails on the cover, wherein when the cover is extended rearwardly of the magazine housing, the heads of the tee nails may be inserted into the longitudinal groove in the magazine housing, and wherein when the cover is slidably moved forwardly of the magazine housing and into the normal closed position covering the magazine housing, the heads of the tee nails are supported between the complementary opposed longitudinal grooves in the magazine housing and the cover, respectively;

means for urging the tee nails forwardly in the trackway in the magazine comprising the interior wall of the magazine housing including a base portion having a nail groove extending longitudinally from the first end to the second end of the interior wall, the shanks of the tee nails terminating in respective points disposed in the nail groove, a pusher plate slidably disposed in the nail groove and adapted to contact the shank of the tee nails, the cover including a laterally-offset longitudinal channel communicating with the interior wall of the cover, a sliding block in the longitudinal channel, means for securing the sliding block to the pusher plate for conjoint sliding movement longitudinally of the magazine, and resilient means comprising a spring positioned in the channel rearwardly of the sliding block for constantly urging the sliding block and hence the pusher plate forwardly of the magazine;

releasable latch means for the cover for the magazine housing comprising the cover having a rearward end portion, the magazine housing including a top portion having a rearward end portion thereof, a latch plate having a pair of end portions, means for mounting the first end portion of the latch plate to the top portion of the magazine housing near the rearward end thereof, the second end of the latch plate extending rearwardly of the magazine housing and beyond the rearward end thereof, such that the latch plate is cantilever mounted on the top portion of the magazine housing, the latch plate further having a downwardly extending protuberance thereon, intermediate of the first and second ends of the latch plate, such that the protuberance engages the rearward end portion of the cover; thereby retaining the cover in its normal closed position on the magazine housing; wherein when the latch plate is lifted upwardly, the protuberance on the latch plate clears the rearward end portion of the cover, thereby releasing the cover and allowing the cover to be slidably moved rearwardly of the magazine housing, and thereby allowing the tee nails to be loaded into the magazine; and a stop means cooperating between the magazine housing and the slidable cover to limit the rearward extension of the cover, thereby preventing a complete separation of the magazine housing and the cover, the stop means comprising a stopping plate mounted on the cover and extending upwardly therefrom, and a checking plate mounted on the magazine housing and extending downwardly therefrom, whereby the checking plate intercepts the stopping plate when the slidable cover is extended rearwardly, thereby preventing a complete separation of the magazine housing and the cover.

5. A tool for driving tee-shaped nails, wherein the tool includes a magazine for receiving the nails, and wherein each nail includes a shank portion and further includes a tee-shaped head portion extending substantially at right angles to the shank portion, the combination comprising:

a magazine housing having an exterior wall and an interior wall, the interior wall having first and second ends, respectively, and the interior wall further having at least one groove extending longitudinally thereof from the first end to the second end thereof;

a cover slidably moved on the magazine housing, the cover having an exterior wall and an interior wall, the interior wall of the cover having first and second ends, respectively, ad the interior wall of the cover further having at least one groove extending longitudinally thereof from the first end to the second end thereof; wherein when the cover is in a normal closed position covering the magazine housikng, the groove in the cover is opposed to, and complementary of, the groove in the magazine housing, thereby forming a trackway for the tee nails in the magazine;

means for mounting the cover on the magazine housing, so that the cover may be slidably extended rearwardly of the magazine housing; wherein when the cover is extended rearwardly of the magazine housing, the heads of the tee nails may be inserted into the longitudinal groove in the magazine housing; and wherein when the cover is slidably moved forwardly of the magazine housing and into the normal closed position covering the magazine housing, the heads of the tee nails are supported between the complementary opposed longitudinal grooves in the magazine housing and the cover, respectively;

means for urging the tee nails forwardly in the trackway in the magazine; and a releasable latch means for the cover for the magazine housing.

6. The tool of claim 5, wherein the means for mounting the cover on the magazine housing comprises a pair of parallel longitudinal rails formed on the cover, and the magazine housing having a pair of complementary parallel longitudinal guide tracks formed therein to receive the rails on the cover.

7. The tool of claim 5, wherein the releasable latch means for the cover for the magazine housing comprises the cover having a rearward end portion, the magazine housing including a top portion having a rearward end portion thereof, a latch plate having a pair of end portions, means for mounting the first end portion of the latch plate to the top portion of the magazine housing near the rearward end thereof, the second end of the latch plate extending rearwardly of the magazine housing and beyond the rearward end thereof, such that the latch plate is cantilever mounted on the top portion of the magazine housing, and wherein the latch plate is sufficiently flexible to enable the latch plate to be lifted upwardly relative to the magazine housing, the latch plate further having a downwardly extending protuberance thereon, intermediate of the first and second ends of the latch plate, such that the protuberance engages the rearward end portion of the cover; thereby retaining the cover in its normal closed position on the magazine housing; wherein when the latch plate is lifted upwardly, the protuberance on the latch plate clears the rearward end portion of the cover, thereby releasing the cover and allowing the cover to be slidably moved rearwardly of the magazine housing, and thereby allowing the tee nails to be loaded into the magazine.

8. The tool of claim 5, further comprising a stop means cooperating between the magazine housing and the slidable cover to limit the rearward extension of the cover, thereby preventing a complete separation of the magazine housing and the cover.

9. The tool of claim 8, wherein the stop means comprises a stopping plate mounted on the cover and extending upwardly therefrom, and a checking plate mounted on the magazine housing and extending downwardly therefrom, whereby the checking plate intercepts the stopping plate when the slidable cover is extended rearwardly, thereby preventing a complete separation of the magazine housing and the cover.

10. The tool of claim 5, wherein the means for urging the tee nails forwardly in the trackway in the magazine comprises the interior wall of the magazine housing including a base portion having a nail groove extending longitudinally from the first end to the second end of the interior wall, the shanks of the tee nails terminating in respective points disposed in the nail groove, a pusher plate slidably disposed in the nail groove and adapted to contact the shank of the tee nails, the cover including a laterally-offset longitudinal channel communicating with the interior wall of the cover, a sliding block in the longitudinal channel, means for securing the sliding block to the pusher plate for conjoint sliding movement longitudinally of the magazine, and resilient means in the channel for constantly urging the sliding block and hence the pusher plate forwardly of the magazine.

11. The tool of claim 10, wherein the resilient means comprises a spring positioned in the channel rearwardly of the sliding block.

12. The tool of claim 10, wherein the offset channel in the cover has a window rearwardly of the stopping plate, whereby the quantity of nails within the magazine can be observed to determine when additional nails are needed.

13. The pusher plate of plate of claim 10, wherein the plate has a plurality of notches where the plate contacts the shank of the tee nails, the notches corresponding to the grooves in the interior wall of the magazine housing and the grooves in the interior wall of the cover, the notches reducing translational movement of the tee nails in urging the tee nails forwardly in the trackway in the magazine.

14. The tool of claim 5, further including a plurality of parallel grooves in the interior wall of the magazine housing extending longitudinally thereof from the first end to the second end thereof; and the interior wall of the cover further having a plurality of parallel grooves extending longitudinally thereof from the first end to the second end thereof; wherein when the cover is in a normal closed position covering the magazine housing, the grooves in the cover are opposed to and complementary of the grooves in the magazine housing thereby forming a plurality of trackways in the magazine thereby accommodating tee shaped headed fasteners of different lengths respectively.

* * * * *

US004815647B1

REEXAMINATION CERTIFICATE (1872nd)

United States Patent [19]

Chou

[11] B1 4,815,647

[45] Certificate Issued Dec. 8, 1992

[54] MULTIPLE-FUNCTION MAGAZINE FOR TEE NAILS TO BE USED WITH A NAILING GUN

[76] Inventor: Joseph S. Y. Chou, 12, Lane 428, Chung Cheng N. Rd., San Chung City, Taipei Hsien, Taiwan

Reexamination Request:
No. 90/002,530, Dec. 2, 1991

Reexamination Certificate for:

| | |
|---|---|
| Patent No.: | 4,815,647 |
| Issued: | Mar. 28, 1989 |
| Appl. No.: | 928,367 |
| Filed: | Nov. 10, 1986 |

[51] Int. Cl.[5] ..... B25C 1/04; B27F 7/14
[52] U.S. Cl. ..... 227/109; 227/120

[56] References Cited

U.S. PATENT DOCUMENTS

| | | | |
|---|---|---|---|
| 3,720,364 | 3/1973 | Maestri | 227/109 |
| 4,304,349 | 12/1981 | Novak et al. | 227/109 |
| 4,375,867 | 3/1983 | Novak et al. | 227/109 |

FOREIGN PATENT DOCUMENTS 73984 1/1986 Taiwan .

OTHER PUBLICATIONS

Taiwanese Patent Gazette, Jan. 16, 1986, vol. 13, No. 2 75 1 16, 73984 Multiple-Function Propeller for Tee Nails (English Translation).

*Primary Examiner*—Paul A. Bell

[57] ABSTRACT

A multi-function magazine for tee nails which accommodates nails of different lengths simultaneously and from which nails exit straight, free of jamming. The magazine comprises a housing having at least one longitudinal groove on the inner wall. Slidably mounted on the housing is a cover with a longitudinal groove opposed to, and complementary of the groove in the housing, thereby forming a trackway for the tee nails. A releasable latch means retains the magazine in a closed position and also enables the cover to be slidably moved rearwardly to load the nails from the side of the magazine. A stop means prevents complete separation of the housing and the cover. A pusher, slidably mounted between the housing and the cover, is in contact with the shanks of the nails. The pusher is urged by a spring to push the nails forwardly in the magazine.

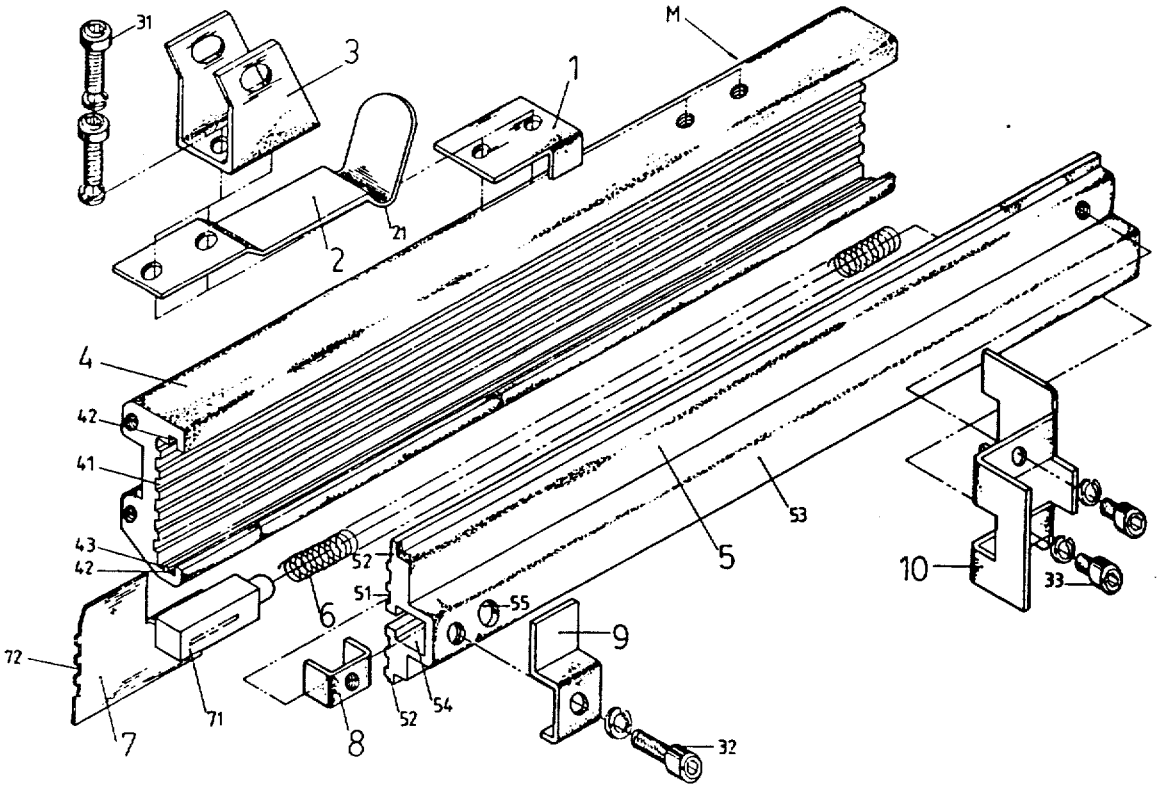

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-14 are cancelled.

* * * * *